US009352871B2

(12) United States Patent
Kern et al.

(10) Patent No.: US 9,352,871 B2
(45) Date of Patent: May 31, 2016

(54) BALE WIRE CUTTER

(71) Applicant: Voith Patent GmbH, Heidenheim (DE)

(72) Inventors: Frank Kern, Erftstadt (DE); Ingo Jonen, Rheinbach (DE); Stephan Liedemann, Erftstadt (DE)

(73) Assignee: Voith Patent GmbH, Heidenheim (DE)

( * ) Notice: Subject to any disclaimer, the term of this patent is extended or adjusted under 35 U.S.C. 154(b) by 266 days.

(21) Appl. No.: 14/065,466

(22) Filed: Oct. 29, 2013

(65) Prior Publication Data

US 2014/0053701 A1 Feb. 27, 2014

Related U.S. Application Data

(63) Continuation of application No. PCT/EP2012/056634, filed on Apr. 12, 2012.

(30) Foreign Application Priority Data

Apr. 29, 2011 (DE) ..... 10 2011 017 770

(51) Int. Cl.
*B65B 69/00* (2006.01)

(52) U.S. Cl.
CPC ..... *B65B 69/0025* (2013.01); *Y10T 83/4705* (2015.04)

(58) Field of Classification Search
CPC ..... B65B 69/0025; Y10T 29/5139; Y10T 29/4982; Y10T 83/4705; Y10T 83/909
See application file for complete search history.

(56) References Cited

U.S. PATENT DOCUMENTS

| | | | | |
|---|---|---|---|---|
| 3,513,522 | A | 5/1970 | Thomson | |
| 5,179,878 | A * | 1/1993 | Kranefeld | B65B 69/0025 29/426.4 |
| 5,297,329 | A * | 3/1994 | Santin | B65B 69/0025 29/564.3 |
| 5,680,691 | A | 10/1997 | Marom et al. | |
| 5,813,199 | A | 9/1998 | Temburg | |
| 7,963,086 | B2 * | 6/2011 | Porter | B65B 69/0025 53/381.1 |
| 2005/0199310 | A1 | 9/2005 | Peters et al. | |

FOREIGN PATENT DOCUMENTS

| | | | |
|---|---|---|---|
| GB | 2184704 | A * | 7/1987 |
| JP | 57-204841 | A | 12/1982 |
| WO | WO-2010002335 | A1 * | 1/2010 |

OTHER PUBLICATIONS

Notice of Transfer of International Research Report and the Written Notice Issued for International Searching Authority or Statement dated Jul. 17, 2012 for International Application No. PCT/EP2012/056634 (10 pages).

* cited by examiner

*Primary Examiner* — Stephen Choi
(74) *Attorney, Agent, or Firm* — Taylor IP, P.C.

(57) ABSTRACT

A device for cutting a strapping off of a cuboid bale includes at least one cutter bar that can be moved toward the bale, wherein the bale is guided along the cutter bar by a conveying apparatus and the cutter bar is arranged on a side of the bale that is directed perpendicularly to a conveying direction. Efficient cutting of all strapping is made possible by arranging at least two cutter bars on adjoining sides of the bale and by guiding the cutter bars in a traversing device in the conveying direction during the contact with the bales.

14 Claims, 2 Drawing Sheets

BALE WIRE CUTTER

CROSS REFERENCE TO RELATED APPLICATIONS

This is a continuation of PCT application No. PCT/EP2012/056634, entitled "BALE WIRE CUTTER", filed Apr. 12, 2012, which is incorporated herein by reference.

BACKGROUND OF THE INVENTION

1. Field of the Invention

The present invention relates to a device for removing strappings from a bale of materials, and, more particularly, to a device that uses at least two cutter bars to remove strappings from the bale.

2. Description of the Related Art

Waste paper, pulp, scrap textiles, scrap plastic bottles etc. are delivered almost exclusively in bales for processing; the weight of the bales can be between 100 and 1500 kg. The bales are generally secured by metal, plastic or other material strapping. Cutting off the strapping, and removing the strapping, is useful to process the material. In addition to manual cutting, machines can be utilized for this purpose which press a cutter bar from the top onto the bale, severing the strapping. During movement of the cutter bar, conveying of the bales is briefly interrupted which is time-consuming and stresses the conveying apparatus. Moreover, it must be ensured that all strapping which is to be cut progresses through the topside of the bale. This may become problematic if the bales rest on the wrong side or if the strapping encircles all sides of the bale.

What is needed in the art is a device that can efficiently cut the strappings around a bale.

SUMMARY OF THE INVENTION

The present invention provides at least two cutter bars that are arranged on adjoining faces of a bale and in that during contact with the bale the cutter bars are guided in a traversing device in a conveying direction. This movement in the conveying direction can occur without a drive-through friction with the bale.

By utilizing two cutter bars on adjoining faces of the bale, all strapping encircling the bale can be cut, regardless of the position of the bale. Moreover, due to the movement of the cutter bar along with the bale which is to be cut, stopping of a conveying apparatus during cutting becomes unnecessary. The respective cutter bars can be moved along with the bale during the entire contact with the bale while strong pressure is applied upon the bale. It is advantageous if the traversing device has the same speed in the conveying direction as the conveying apparatus. Nevertheless, the cutting process—subject to the design of a cutting apparatus of the cutter bar—may also be supported by a slight relative movement between the cutter bar and the bale. After the cutting operation, the cutter bar is moved away from the bale and the traversing device is returned to the starting position. In the interest of a robust and simple construction, the conveying apparatus can be a conveyor running underneath the bale. Since the bale generally rests on the conveying apparatus and is oriented by the same, it is advantageous if at least one cutter bar is located above the bale.

In order to prevent shifting of the bale while cutting the strapping, as well as damage to the conveying apparatus and cutting apparatus due to pieces breaking loose from the bale, the bale can be guided laterally, from both sides of the conveying apparatus, by a side wall in a region of the cutter bars.

To pre-secure the bale on the conveying apparatus, the top cutter bar can be pressed onto the bale before the respective lateral cutter bar.

To complete the cutting process at least one cutter bar is located perpendicularly to the conveying apparatus and laterally relative to the bale, although other cutter bar positions are also conceivable. The side wall on the side of this lateral cutter bar is connected with the traversing device. The associated side wall effectively protects the cutter bar and the traversing device from function impairment caused by materials coming loose from the bale. For two-sided securing and severing, particularly if two bales are resting on the conveying device adjacent to one another transversely to the conveying direction, it is advantageous if at least one cutter bar is arranged on both sides of the conveying device. In one embodiment, the side wall which is connected with the traversing device is provided with a slot which permits a movement of the cutter bar beyond this sidewall to the bale. However, other designs are also conceivable where parts of the cutter bar are arranged between the bale and the side wall.

In order to avoid pieces which have become detached from the bale falling off the conveying device before and/or after the movable side wall, both ends of the sidewall connected with the traversing device should cover a corresponding end of an adjacent lateral stationary side wall.

For implementation of the actual cutting process, it is advantageous that the cutter bars have at least one cutting edge facing in the direction of the bale when pressing the cutter bars against the bale. However, differently configured cutting devices may also be mounted to the cutter bar.

Special advantages result in the use of the inventive device if the bales are plastic, textile, fibrous material or waste paper bales with strapping encircling all sides.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

FIG. is 1 is a top view of the cutting device.

Corresponding reference characters indicate corresponding parts throughout the several views. The exemplifications set out herein illustrates embodiments of the invention and such exemplifications are not to be construed as limiting the scope of the invention in any manner.

DETAILED DESCRIPTION OF THE INVENTION

A cuboid bale 2 includes, for example, waste paper which is transported in a conveying direction 4 by a conveying apparatus 5, such as a conveyor, for further processing to a downstream processing device, for example a pulper. For this purpose, a strapping 1 which is present on all sides of the bale 2 must be severed.

Figure 1:
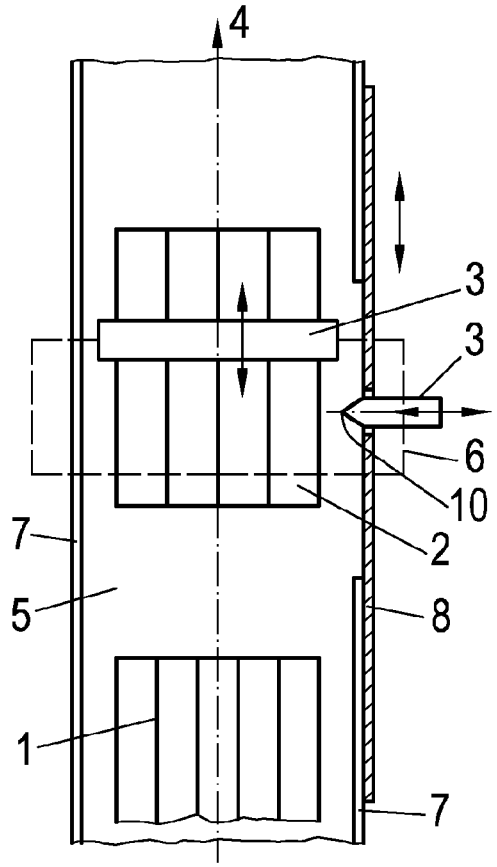
Figure 2:
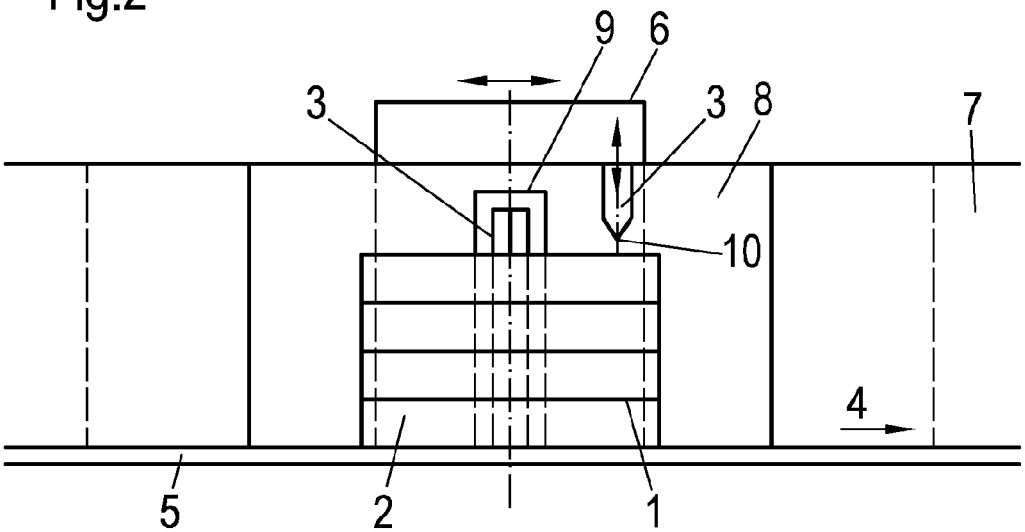
FIG. 2 is a side view of the cutting device shown in FIG. 1.

According to the arrangement illustrated in FIGS. 1 and 2, severing of the strapping 1 occurs with a cutting device which consists substantially of two cutter bars 3, each of which are equipped with a cutting edge 10 pointing toward the bale 2. It should be appreciated that the cutter bars 3 are illustrated generally as rectangles with cutting edges 10 for ease of illustration and that any type of cutter bars and associated movement mechanisms can be incorporated in the cutting device according to the present invention. To sever the strapping 1, the cutter bars 3 are pressed in the direction of the respective bale 2. After severing, the cutter bars 3 return to a starting position.

So that severing of the strapping 1 is not impaired by the movement of the bale 2 on the conveying apparatus 5, but also allowing the conveying apparatus 5 to be operated continuously, the cutter bars 3 are moved continuously and synchronously with the conveying apparatus 5 by a traversing device 6 during the severing process. After cutting, the traversing device 6 returns the cutter bars 3 into the starting position.

In order to ensure—as much as possible—that all the strapping 1 is severed, one cutter bar 3 is located above the bale 2 and another cutter bar 3 is located laterally adjacent. Whereas the upper cutter bar 3 is pressed downward onto the bale 2 for cutting, the lateral cutter bar 3 is pressed against the respective face of the bale 2.

It is desirable to prevent pieces of the bale 2, particularly in a region of the cutting device, from falling off the conveying device 5 and impairing its function. The bale 2 is therefore guided laterally by a side wall 8 or a lateral stationary side wall 7 which extends in the conveying direction 4, and in a simple embodiment consists of a guide plate. During cutting, the conveying device 5 can locate the bale 2 relative to the upper cutter bar 3, and the lateral stationary side wall 7 relative to the lateral cutter bar 3. The side wall 8 is connected with the traversing device 6 in the region around the lateral cutter bar 3 in order to protect this region from contamination. This means that the side wall 8 is moved back to its starting position together with the lateral cutter bar 3 in the conveying direction 4. In order for lateral cutter bar 3 to move unimpeded through the side wall 8 to the bale 2 and away again, the side wall 8 is provided with a slot 9. To complete guidance away from the region around the lateral cutter bar 3, both ends of the side wall 8 connected with the traversing device 6 transition into the lateral stationary side wall 7. For this purpose, the sidewall 8 and the lateral stationary side wall 7 overlap each other in each position of the cutter bar 3.

Figure 3:
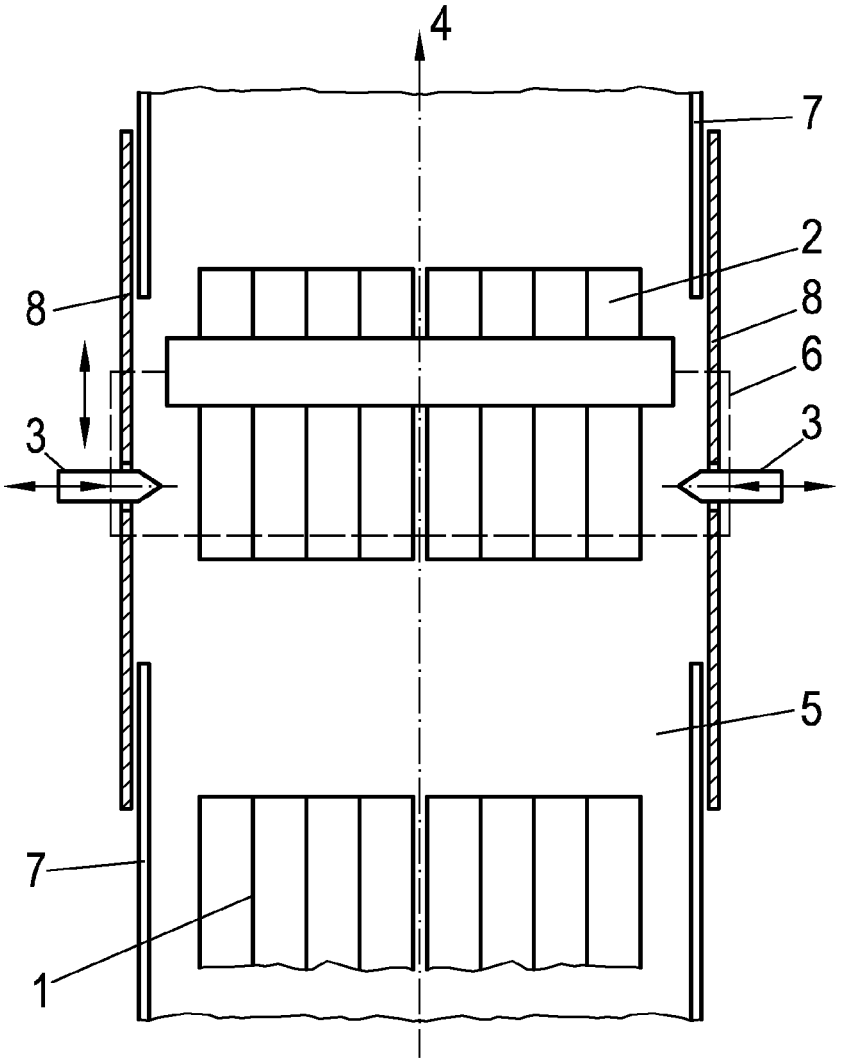
FIG. 3 is a top view of another embodiment of a cutting device of the present invention.

In contrast thereto, FIG. 3 shows a cutting device where multiple bales 2 are deposited adjacent to one another on the conveying apparatus 5 transversely to the conveying direction 4. To sever all the strapping 1 of both bales 2, a lateral cutter bar 3 is located adjacent to an upper cutter bar 3 on both sides of the conveying device 5. Both lateral cutter bars 3 are connected with their respective side wall 8 and with the upper cutter bar 3 with a common traversing device 6. Since the lateral cutter bars 3 are pressed with opposite sides of the bale 2 against them, the bale 2 is held in place at the same time as severing the strapping 1.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for cutting a strapping off of a cuboid bale, comprising:

a conveying apparatus configured to guide the bale in a conveying direction;

at least two cutter bars having a cutting edge, one of said at least two cutter bars being configured to move in a vertical direction and said conveying direction and another one of said at least two cutter bars being configured to move in a lateral direction and said conveying direction, wherein at least one of said at least two cutter bars is configured to move toward the bale and at least one of said at least two cutter bars is arranged on a side of the bale oriented perpendicular to said conveying direction; and a traversing device configured to simultaneously guide said at least two cutter bars in said conveying direction during contact with the bale.

2. The device according to claim 1, wherein said traversing device has a same speed in said conveying direction as said conveying apparatus.

3. The device according to claim 2, wherein said conveying apparatus is a conveyor running underneath the bale.

4. The device according to claim 3, wherein at least one of said cutter bars is arranged above the bale.

5. The device according to claim 4, further comprising a side wall to laterally guide the bale from at least one side of said conveying apparatus when the bale is in a region of said cutter bar.

6. The device according to claim 5, wherein at least one of said cutter bars is arranged laterally to the bale and said side wall is connected with said traversing device.

7. The device according to claim 6, wherein said at least two cutter bars comprises at least three cutter bars, said at least three cutter bars including at least one cutter bar arranged on each lateral side of said conveying device.

8. The device according to claim 7, wherein at least two bales rest adjacent to one another on said conveying apparatus transversely to said conveying direction.

9. The device according to claim 6, further comprising a slot provided within said side wall, said side wall and said slot being configured to permit a movement of said laterally arranged cutter bar beyond said side wall to the bale.

10. The device according to claim 5, wherein said side wall is movably connected to said traversing device, wherein each end of said side wall covers a corresponding end of an adjacent lateral stationary side wall in each position of said cutter bar.

11. The device according to claim 5, wherein said side wall is movably connected to said traversing device.

12. The device according to claim 11, further comprising a slot provided within said side wall, said side wall and slot being configured to permit a movement of at least one cutter bar beyond said side wall.

13. The device according to claim 1, wherein the bale comprises at least one of plastic, textile, fibrous material and waste paper with strapping for encircling all sides of the bale.

14. The device according to claim 1, wherein one of said at least two cutter bars is configured to only move in a vertical direction and said conveying direction and another one of said at least two cutter bars is configured to only move in a lateral direction and said conveying direction.

* * * * *